US006540421B1

(12) United States Patent
Porcelli

(10) Patent No.: US 6,540,421 B1
(45) Date of Patent: Apr. 1, 2003

(54) LEASH FOR A WRITING IMPLEMENT

(76) Inventor: Karen M. Porcelli, 3028 Winchester Dr., West Valley City, UT (US) 84119

( * ) Notice: Subject to any disclaimer, the term of this patent is extended or adjusted under 35 U.S.C. 154(b) by 0 days.

(21) Appl. No.: 10/206,173

(22) Filed: Jul. 25, 2002

(51) Int. Cl.[7] ..... A46B 5/02
(52) U.S. Cl. ..... 401/8; 401/131
(58) Field of Search ..... 401/6, 7, 8, 48, 401/131

(56) References Cited

U.S. PATENT DOCUMENTS

| | | | | | |
|---|---|---|---|---|---|
| 865,036 | A | | 9/1907 | Hatfield | |
| 967,410 | A | * | 8/1910 | Montgomery | 401/8 |
| 1,206,976 | A | | 12/1916 | Barth | |
| 1,342,576 | A | | 6/1920 | Wride | |
| 1,603,728 | A | | 10/1926 | Volk | |
| 1,879,489 | A | * | 9/1932 | Ray | 401/8 |
| 3,005,441 | A | | 10/1961 | Glasscock | |
| 3,503,546 | A | | 3/1970 | Hunt | |
| 3,596,964 | A | | 8/1971 | Zazzara | |
| 3,666,372 | A | | 5/1972 | Lipkowski | |
| 4,148,424 | A | | 4/1979 | Fortenberry | |
| D328,920 | S | | 8/1992 | Kimball | |
| 5,542,588 | A | | 8/1996 | Sison | |
| 5,868,509 | A | | 2/1999 | Crutcher | |
| 6,328,494 | B1 | | 12/2001 | Moxom | |

FOREIGN PATENT DOCUMENTS

| | | | | |
|---|---|---|---|---|
| FR | 1100757 | * | 5/1954 | 401/8 |
| GB | 316851 | * | 8/1929 | 401/8 |
| WO | WO 97/34771 | | 9/1997 | |

* cited by examiner

*Primary Examiner*—David J. Walczak
(74) *Attorney, Agent, or Firm*—TraskBritt

(57) ABSTRACT

A leash adapted to return a writing implement from a writing position to a storage position in proximity to a multi-tasking hand for easy retrieval by that hand.

20 Claims, 1 Drawing Sheet

LEASH FOR A WRITING IMPLEMENT

TECHNICAL FIELD

The invention relates to writing implements, and particularly to leashes adapted to return a writing implement to a storage position near a writing hand of a multi-tasking user when released by that hand, and providing for convenient retrieval of the writing implement from the storage position to a writing position by the fingers of that writing hand.

BACKGROUND

Various devices have been developed to hold a writing implement in a spacial relationship with respect to a writer's hand. Certain patented such devices are particularly adapted to teach proper holding skills to a user to improve, for example, penmanship or to enhance motor control over the implement. U.S. Pat. No. 1,342,576 to Wride discloses a device to hold the fingers and hand, as well as a writing implement, in the correct position for proper penmanship. U.S. Pat. No. 1,603,728 to Volk discloses an attachment to teach wearers to not move their fingers while learning to write. Volk's device does not contemplate multi-tasking by a user. U.S. Pat. No. 6,328,494 to Moxon discloses a holder for a writing implement or tool which can be custom fitted to an individual's hand. Moxon's holder is directed to improving comfort and motor control over a device, and does not return the implement to a convenient and out-of-the-way storage position when released for multi-tasking.

Certain other patented devices have been developed to aid in holding a writing implement variously in proximity to a hand to enable writing with the instrument. The device disclosed in U.S. Des. 328,920 to Kimbal appears to be adapted to hold a writing implement at a writing position at the end of a finger only, and would not permit a released writing implement to return to an out-of-the-way storage position to facilitate multi-tasking of a hand. U.S. Pat. No. 5,868,509 to Crutcher discloses a holder for a writing implement that is worn like a ring on a finger, but inherently precludes holding the implement at a natural writing position between a user's fingers and thumb.

Other United States patents and International Applications disclose devices that have been developed to aid in multi-tasking of a hand and to include writing as one alternating task. U.S. Pat. No. 865,036 to Hatfield discloses an attachment for penholders that is worn like a ring on a finger and can be rotated out of the way by a user to permit the user to pick up a second pen or a pencil. U.S. Pat. No. 1,206,976 to Barth discloses a flexible band folded upon itself to form a first loop in which to hold a writing implement, and a second loop to be worn on a user's finger. The writing implement is retrievable from a position at an incline above a plane of the finger joint wearing the second loop to a writing position by rotating the material between the two loops. U.S. Pat. No. 3,005,441 to Glasscock discloses a thumb-mounted ring that carries a transversely mounted tube in which a writing implement may be deployed retractably to slide between a storage position and a writing position. U.S. Pat. No. 3,503,546 to Hunt discloses an implement holder with a band worn around the back of a hand at the palm area and carrying a spring biased mechanism to hold a writing implement either in the palm area or at a position for writing. U.S. Pat. No. 3,596,964 to Zazzara discloses a split resilient finger band and a mechanically coupled split resilient sleeve to hold an implement. Zazzara's coupling permits rotation of the sleeve about an axis, but is not resiliently biased. Friction is relied upon to maintain an orientation of a writing implement. U.S. Pat. No. 3,666,372 to Lipowski discloses a coupling device having a first body worn on the user's pointer finger and flexibly hinged to a second body adapted to hold a writing implement. Lipowski's device permits the implement to be retrieved from a position parallel to the axis of the finger joint that is wearing the first body to a writing position. U.S. Pat. No. 4,148,424 to Fortenberry discloses a band worn around a hand in the palm area and providing a loop in which a writing instrument may be inserted. The implement can be rotated by the user from alignment with a plane defined by the user's palm to a writing position. U.S. Pat. No. 5,542,588 to Sison discloses a device wrapped about the back and palm of a hand and includes a rigid extension wrapped about a portion of the user's thumb. A writing implement is inserted into engagement with material between a plurality of slots in Sison's device. PCT International Publication WO 97/34771 to O'Mara et. al discloses a short-barrelled writing implement affixed to a retainer that is worn on a middle finger like a ring. The wearer rotates the writing element out of a writing position when not in use.

While the aforementioned devices represent advances in ease of use of writing implements, on the whole, they are relatively complex to use and undesirably expensive to manufacture. It would be a further advance to provide a holder, or leash, for a writing implement which permits multi-tasking of a hand and that is simple, easy to use, and inexpensive to manufacture.

BRIEF SUMMARY OF THE INVENTION

The present invention provides an apparatus to hold a released writing implement in a convenient location relative to a multi-tasking user's hand to permit retrieval of the implement without requiring significant displacement of that hand. The apparatus forms a leash for the writing implement and typically includes a flexible, resilient, and substantially planar body. A first aperture, having an axis oriented in a body thickness direction and passing through the body, is sized to receive a human thumb and can expand in diameter to receive thumbs of different sizes. A second aperture, having an axis oriented in a thickness direction and passing through the body, is spaced apart from the first aperture, and is sized smaller than a shaft of a writing implement to form a self-biased engagement with an installed implement.

A typical leash has a body that is operable when worn on a user's thumb like a ring to move an installed writing implement to a storage position subsequent to release of the implement from a writing position in a multi-tasking user's fingers, with the storage position being at a substantially uniform and repeatable orientation and at a substantially fixed distance relative to the user's hand. Additionally, a leash according to the invention permits the writing implement to be retrieved from the storage position by manipulating the fingers of the writing hand without requiring a global displacement of the hand to retrieve the implement, or assistance from the other hand.

In general, a body of a leash includes a prismatic member with an approximately uniform thickness, typically being between about 1/16 inch and about 1/4 inch in thickness. A leash body may consist of a one-piece prismatic member. In other embodiments within contemplation, the leash may include a one-piece prismatic member. The prismatic member is warpably deformable to permit unaided fingers of a user's writing hand to retrieve a writing implement from its storage position to a writing position.

A workable leash may be formed from material removed from a planar sheet of a resilient material having an approximately uniform thickness between first and second surfaces thereof. Suitable materials for construction of a leash according to the present invention include: closed cell foam, open cell foam, art foam, leather, urethane, rubber, and plastic. In general, when the leash is in an unbiased state, an axis of a thumb aperture is parallel to an axis of the implement-holding aperture. In any case, a leash can be constructed to have a one-piece planar body that has sufficient flexibility to deform whereby to permit the user to move an implement from a stored location to a writing position. Some leashes may have a body that is configured and arranged to have a shape of an animal or flower in profile. A plurality of leashes may be spaced apart and disposed substantially in parallel to support heavy writing implements.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENT

Figure 1:
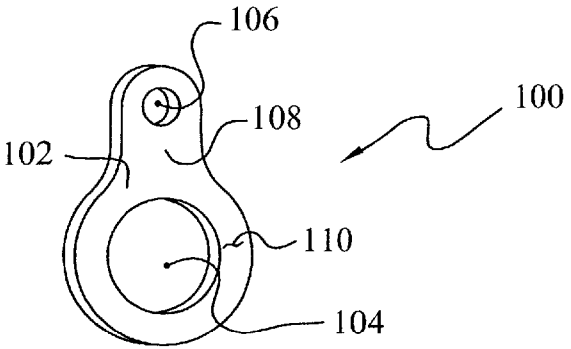
FIG. 1 is a view in perspective of a preferred embodiment of the invention.

FIG. 1 illustrates one currently preferred embodiment of a leash for a writing implement, generally indicated at 100, according to principals of the invention. The operating characteristics and low manufacturing costs associated with the invention are inherent in the configuration of the device 100. In an unbiased position, a leash 100 may be substantially flat, or can be defined as being bounded by a rectangular box. The illustrated body 102 may also be characterized as being prismatic and substantially planar when in an undeformed state. Leash 100 includes a body 102, a digit-recieving aperture 104, and an aperture 106 in which to receive a writing implement. A cross-section of the illustrated body 102, taken along a straight-line path between the apertures 104 and 106 and through the thickness of the body, is generally rectangular. The apertures 104 and 106 desirably are resilient to expand and accommodate insertion therein of a digit, such as a thumb, and a writing implement, respectively. The material forming the body 102 desirably is resilient to urge the body toward an unbiased position and to hold an implement in registration with aperture 106.

Still referencing FIG. 1, body 102 typically includes a prismatic member 108 extending lengthwise in a direction between the apertures 104 and 106. Prismatic member 108 forms a resilient spring operable to move a writing implement from a writing position to a storage position. Deformation of prismatic member 108 by twisting, bending, rotating, stretching, or otherwise warping causes a bias that tends to return prismatic member 108 to an undeformed orientation. While prismatic member 108 is illustrated as substantially rectangular, any operable shape may be used. In fact, the leash 100 may be formed to suggest some sort of object, such as an animal, or a flower. One embodiment within contemplation for a leash 100 includes a giraffe's neck serving as a prismatic member 108 with the giraffe's head functioning to hold the writing implement. It is further within contemplation to form a lion's head configured to hold a writing implement in the lion's mouth.

It should be noted that axes of apertures 104 and 106 typically are oriented parallel to each other and perpendicular to a front surface 110. A rear surface (not illustrated) generally is disposed in parallel to surface 110 to define a thickness of the prismatic member 108 of leash 100. As illustrated in FIG. 1, aperture 104 is sized to receive an adult thumb and has a diameter of about ¾ inch. Aperture 106 is sized to retain a pencil or pen and has a diameter of about ¼ inch. An axis of aperture 104 is spaced apart from an axis of aperture 106 by about 1-¼ inches. Of course, the sizes of apertures and the spacing between axes can be varied as desired to accommodate other writing implements and changes in size between various user's hands.

Leashes 100 may have any thickness operable to fit on a thumb or other digit. While a leash 100 may be worn on a finger, it is currently preferred to install the leash 100 on a thumb. A thumb inherently provides more radial clearance, compared to a finger, in which to accommodate the body material surrounding the aperture 104. It is currently preferred to manufacture a leash 100 to have a thickness between about 1/16 inch and about ½ inch, or so. The thickness of a leash 100 may vary from place to place over the area of a leash 100, although, as a manufacturing convenience, it is currently preferred for the thickness to be a relatively constant value.

Leashes according to the invention can be made from a wide variety of materials. Materials within contemplation nonexclusively include leather, rubber, urethane, open and closed cell foam, art foam, and plastic. Leashes can be formed by molding, including injection molding, or by a punching process, such as die cutting or stamping. A cookie-cutter type die can be employed to remove leashes from sheet material. It is currently preferred to die cut leashes 100 from art foam sheet material having a relatively uniform thickness. Currently desired thicknesses range between about ¼ and about 1/16 inch, although leashes having greater thicknesses are operable. The material forming a leash 100 may include surface texture and solid and patterned colors.

Figure 3:
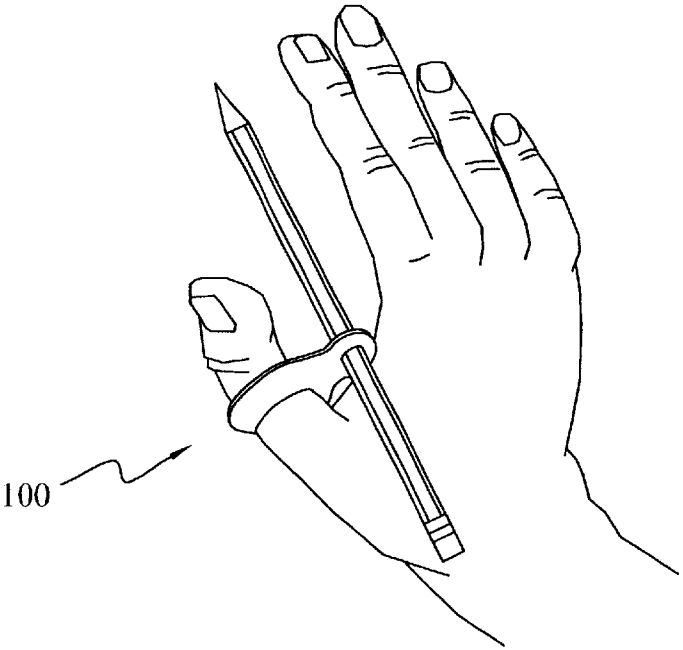
FIG. 3 is a perspective view of the embodiment of FIG. 1 attached to a multi-tasking hand and holding a writing implement at a storage location.
Figure 2:
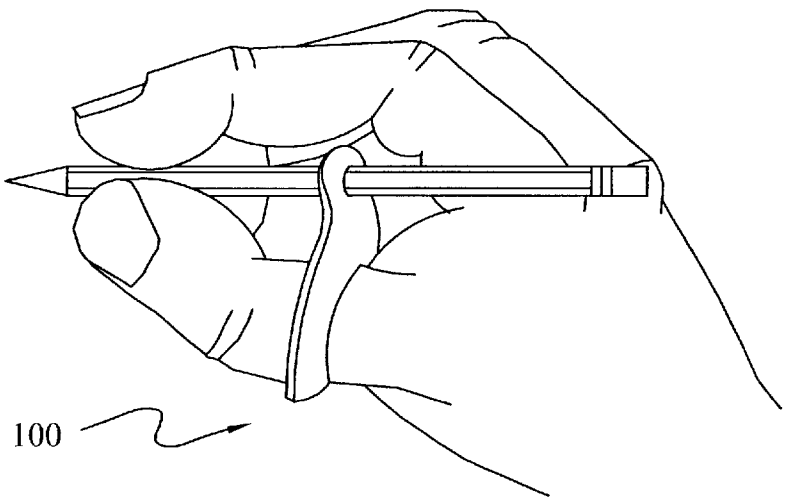
FIG. 2 is a perspective view of the embodiment of FIG. 1 attached to a hand and warped into a deformed configuration to hold a writing implement at a writing location for use in writing.

As illustrated in FIGS. 2 and 3, a leash according to the present invention is capable of returning a writing implement from a writing position to a storage position that is located in proximity to a multi-tasking hand for easy retrieval by that hand. FIG. 2 illustrates the leash 100 with prismatic member 108 (not labeled in FIG. 2) in a warped configuration to hold a pencil at a natural writing position. FIG. 3 illustrates the leash 100 having resiliently returned the pencil to a storage position maintained at a relatively uniform distance to the hand to permit retrieval of the implement by that hand and to permit the fingers of that hand to perform an additional task, such as: entering numbers on a 10-key pad, filing papers, or typing.

In operation of the leash 100, a user inserts a writing implement into aperture 106. Aperture 106 is sized smaller the a shaft of the implement to form a self-biased engagement with the shaft. Aperture 104 preferably receives the user's thumb, although a finger is sometimes also operable. On insertion of a thumb, the body 102 may cup as the wall forming the aperture 104 expands to receive the thumb. Such cupping can operate structurally to stabilize the adjacent end of prismatic member 108 to assist in keeping a writing implement at a storage position. The fingers of the user's writing hand can be manipulated to grasp the implement and place it into writing service by warpably deforming prismatic member 108, as illustrated in FIG. 2. When the user releases the implement, the implement is automatically moved to a storage position, as illustrated in FIG. 3, by a resilient bias generated in warped prismatic member 108 and operating to return member prismatic 108 toward an undeformed position. Sometimes, the user may additionally rotate a leash 100 about the thumb's axis to further free the finger area for multi-tasking. Returning the implement from the storage position to a writing position can be accomplished without either requiring aid from the user's other hand, or displacing the writing hand to pick up the implement.

It is also within contemplation to form an alternative leash having a first cylindrical body forming an aperture to hold a writing implement, a second cylindrical body forming an aperture in which to receive a thumb or finger, and a warpable prismatic member 108 disposed between the two apertures. As contemplated, the unbiased prismatic member 108 is disposed in a plane approximately perpendicular to the axes of the apertures. The alternative cylindrical bodies may further include slits disposed to facilitate biased expansion of an aperture inside diameter. In such an alternative leash embodiment, the prismatic member 108 may be warped to place a writing implement into a writing position. When the implement held in such alternative leash is release, the prismatic member 108 will resiliently deflect to place the implement into a storage location.

Writing implements operable in combination with the invention non-exclusively include pencils, markers, pens, chalk, and crayons. In certain cases where heavy writing implements are to be used, two or more leashes 100 may be stacked together to operate approximately in parallel to support the implement. In certain such cases, a spacing between certain of the two or more leashes 100 can also be beneficial.

What is claimed is:

1. A leash for a writing implement, comprising:

a flexible, resilient, and substantially planar body;

a first aperture passing through said body and sized to receive a human thumb;

a second aperture, spaced apart from said first aperture, passing through said body and sized smaller than a shaft of a writing implement to form a self-biased, holding, engagement with an installed said shaft;

wherein said body is operable, when worn on a user's thumb like a ring, resiliently to move an installed writing implement to a storage position subsequent to release of said implement from a writing position in a multi-tasking user's fingers, said storage position being at a substantially uniform and repeatable orientation and at a substantially fixed distance relative to the user's hand, said body further permitting said writing implement to be retrieved from said storage position by manipulating said fingers of said hand without requiring a global displacement of said hand to retrieve said implement.

2. The leash of claim 1, wherein, when said body is in an unbiased state, a first axis of said first aperture is parallel to a second axis of said second aperture.

3. The leash of claim 1, wherein said body consists of a one-piece prismatic member.

4. The leash of claim 1, wherein said body comprises a one-piece prismatic member.

5. The leash of claim 1, wherein said body is a one-piece body having sufficient flexibility to deform whereby to permit the user to move an implement between said stored location and said writing position.

6. The leash of claim 1, wherein:

said first aperture is resiliently expandable in size to accommodate human thumbs of different sizes.

7. The leash of claim 1, wherein:

said body has an approximately uniform thickness, said thickness being between about 1/16 inches and about 1/4 inches.

8. The leash of claim 1, wherein:

said body has an approximately uniform thickness, said thickness being between about 1/16 inches and about 3/16 inches.

9. The leash of claim 1, wherein:

said body has an approximately uniform thickness, said thickness being between about 1/16 inches and about 1/8 inches.

10. The leash of claim 1, wherein said body comprises material removed from a planar sheet of a material having an approximately uniform thickness between first and second surfaces.

11. The leash of claim 10, wherein an axis of said first aperture is oriented substantially perpendicular to said first surface.

12. The leash of claim 11, wherein an axis of said second aperture is substantially perpendicular to said first surface.

13. The leash of claim 10, wherein said material of said body is selected from the group comprising: closed cell foam, open cell foam, art foam, leather, urethane, rubber, and plastic.

14. The leash of claim 10, wherein said body is configured and arranged to have a shape of an animal in profile.

15. The leash of claim 10, wherein said body is configured and arranged to have a shape of a flower in profile.

16. In an improved leash, for a writing implement, of the type worn on a user's thumb and capable of returning the writing implement to a storage position, located at a substantially uniform and repeatable orientation and at a substantially fixed distance relative to the user's hand, subsequent to release of the implement from the user's fingers at a writing position, the improvement comprising:

a body having a generally prismatic profile in a cross-section taken through said body in a thickness direction, said body defining and spacing apart a thumb aperture and an implement aperture, said body being formed from a material having sufficient resilience and flexibility to maintain said implement at said storage position until said body is deformed to place said implement at said writing position.

17. The leash of claim 16, wherein a first axis of said thumb aperture and a second axis of said implement aperture are oriented substantially parallel to said thickness direction.

18. An improved leash for a writing implement; the leash of the type worn on a thumb of a multi-tasking user's hand and operable to return a writing implement to a storage position, located at a substantially fixed distance relative to the user's hand, subsequent to release of the implement from a writing position in the user's fingers of that hand, the improvement comprising:

a body comprising a prismatic, substantially planar, elastic member having a memory, said member being disposed between a thumb receiving aperture and an implement receiving aperture, and further being configured and warpably deformable to permit unaided fingers of the user's said hand to retrieve said implement from said storage position to said writing position.

19. The leash of claim 18, wherein:

said thumb receiving aperture is a passageway formed by an uninterrupted wall having a resilience to expand whereby to accommodate thumbs having different diameters; and said implement receiving aperture has a resilience to expand whereby to create a self-bias operable to retain a writing implement.

20. The leash of claim 19, in combination with a second such leash spaced apart and disposed substantially in parallel to said first leash.

* * * * *